US006972697B2

(12) United States Patent
Vogel et al.

(10) Patent No.: US 6,972,697 B2
(45) Date of Patent: Dec. 6, 2005

(54) CONTROLLER FOR AUTOMATICALLY MANIPULATING A HORN SIGNAL FOR NAVIGATIONAL PURPOSES

(75) Inventors: David A. Vogel, Westwood, MA (US); Richard Andrews, Bellingham, MA (US); Richard McCulley, Jr., Roslindale, MA (US)

(73) Assignee: TSX Products Corp., Norwood, MA (US)

( * ) Notice: Subject to any disclaimer, the term of this patent is extended or adjusted under 35 U.S.C. 154(b) by 56 days.

(21) Appl. No.: 10/630,620

(22) Filed: Jul. 30, 2003

(65) Prior Publication Data

US 2004/0075587 A1 Apr. 22, 2004

Related U.S. Application Data

(60) Provisional application No. 60/444,435, filed on Feb. 3, 2003, provisional application No. 60/399,763, filed on Jul. 31, 2002.

(51) Int. Cl.[7] ..... G08B 23/00

(52) U.S. Cl. ..... 340/984; 340/985; 340/384.4; 340/388.1; 340/404.1; 340/471; 340/474; 116/26; 116/24

(58) Field of Search ..... 340/984, 985, 340/474, 384.71, 384.72, 384.3, 384.4, 384.6, 340/388.1, 404.1, 471; 114/270; 116/26, 116/19, 18, 24; 700/83; 364/188, 189

(56) References Cited

U.S. PATENT DOCUMENTS

| | | | | |
|---|---|---|---|---|
| 2,971,187 | A | 2/1961 | Marr et al. | 340/384 |
| 3,684,895 | A | 8/1972 | Edelson | 307/132 E |
| 4,352,167 | A * | 9/1982 | Hashimoto et al. | 367/127 |
| 4,896,623 | A | 1/1990 | Seibert et al. | |
| 4,903,243 | A | 2/1990 | Turner, Jr. | 367/3 |
| 5,012,757 | A | 5/1991 | Williams | 116/19 |
| 5,072,362 | A | 12/1991 | Lilienthal | 364/188 |
| 5,598,164 | A | 1/1997 | Reppas et al. | |
| 5,671,387 | A | 9/1997 | Jacobs et al. | |
| 5,770,961 | A | 6/1998 | Pontiff | 327/306 |
| 6,139,170 | A * | 10/2000 | Wiggerman | 362/477 |
| 6,359,549 | B1 | 3/2002 | Lau et al. | 340/384.71 |
| 6,473,005 | B2 * | 10/2002 | Showell | 340/984 |

FOREIGN PATENT DOCUMENTS

| | | |
|---|---|---|
| FR | 002619947 A1 | 3/1989 |
| FR | 08712229 | 3/1989 |
| JP | 2000266848 | 9/2000 |
| JP | 2000266848 A | 9/2000 |

* cited by examiner

*Primary Examiner*—Hung Nguyen
(74) *Attorney, Agent, or Firm*—Ohlandt, Greeley, Ruggiero & Perle

(57) ABSTRACT

A system and method for a horn controller is provided that automatically operates a vessel's horn as a foghorn. The horn controller automatically causes the vessel's horn to sound according to the proper foghorn sounding schedule. The horn controller is designed to be installed in a new vessel, and/or to be retrofitted to an existing vessel.

50 Claims, 6 Drawing Sheets

CONTROLLER FOR AUTOMATICALLY MANIPULATING A HORN SIGNAL FOR NAVIGATIONAL PURPOSES

This application claims benefit of 60/399,763 filed on Jul. 31, 2002 and claims benefit of 60/444,435 filed on Feb. 3, 2003.

BACKGROUND OF THE INVENTION

1. Field of the Invention

The present invention relates to a marine navigational aid for providing sound navigational signals. More particularly, the present invention relates to an economic controller for automatically manipulating sound navigational signals generated by a vessel's horn and for providing a pre-signal warning.

2. Description of the Prior Art

While operating marine vessels in limited visibility situations, like fog, the Navigation Rule International Inland, COMDTINST M16672.2D (commonly referred to as 72 COLREGS or simply COLREGS), in Rule 35—Sound Signals in Restricted Visibility, require sounding audible signals according to a predetermined schedule. Normally, the audible signals are produced by a vessel's navigational horn, whistle, or dedicated foghorn. For example, a power vessel over 12 meters in length, making its way through the water is required to sound a horn signaling pattern of "one prolonged blast" at intervals of not more than 2 minutes. A power vessel stopped and not making way through the water is required to sound a horn signaling pattern of "two prolonged blasts" at intervals of not more than 2 minutes, with an interval of about 2 seconds between the two prolonged blasts. A vessel engaged in fishing, sailing vessels, vessels with restricted ability to maneuver, and towing vessels are required to sound a horn signaling pattern of "one prolonged followed by two short blasts". A vessel being towed is required to sound a horn signaling pattern of "one prolonged followed by three short blasts".

Additionally, there are horn signaling patterns unrelated to situations of limited visibility. Distress signals can be either a continuous blast or a short-short-short-long-long-long-short-short-short (SOS pattern). A momentary (i.e. non-repeating) pattern of short-long-short blasts is defined to warn vessels approaching a vessel at anchor.

Although the COLREGS do not require vessels under 12 meters in length to blast the precise patterns described above, they do require an "efficient sound signal at intervals of not more than two minutes". Current practice, (except for some hailers with foghorn capability) especially on smaller vessels, is to manually blast a vessel's existing navigational horn or whistle, and time the blasts manually, for example, using a stopwatch. There is a possibility that errors in timing and in sounding the proper signals may occur when these operations are performed manually.

Once a foghorn signal is heard, nearby vessels will listen for subsequent blasts to determine whether the unseen vessel is approaching or receding. Thus, the timing of the signals is critical to the safety of vessels operating in conditions of limited visibility.

Vessel captains operating alone or with a limited crew may have difficulty in maintaining a proper foghorn schedule due to other tasks that must be performed when operating the vessel, including maintaining lookouts and monitoring navigational instrumentation.

Few vessels used for recreation and recreational fishing have foghorn capability today due to the additional cost and space required to install an additional horn and control panel.

The present invention provides for a device and method that addresses the above-identified limitations. The present invention automatically causes the vessel's existing navigational horn to sound according to a proper schedule. The present invention will be described with reference to a horn, however, the present invention may be utilized with any suitable audible signaling device, such as a whistle or dedicated foghorn. The device of the present invention is designed to be installed in a new vessel, or to be retrofitted to an existing vessel.

Depending upon the installation type, the present invention may require no additional horn or whistle. One installation configuration makes use of the existing navigational horn and horn switch, while the other configuration also has an additional horn signaling pattern mode selector.

SUMMARY OF THE INVENTION

It is an object of the present invention to provide a controller for cooperating with a vessel's existing horn to automatically generate sound navigational signals.

It is another object of the present invention to provide a controller that automatically operates a vessel's horn to generate sound navigational signals that comply with accepted standardized schedules for operating in limited visibility situations, and/or in conditions of limited control (e.g. towed vessel).

It is still another object of the present invention to provide a controller that allows the selection of at least two different modes of signaling.

It is yet another object of the present invention to provide a controller having an anti-synchronization feature for manipulating the time span between horn signals to prevent any overlapping thereof with horn signals generated by different vessels.

It is yet still another object of the present invention to provide a controller that efficiently and economically cooperates with different existing horns in a variety of different vessels.

It is a further object of the present invention to provide a controller that is configurable in two or more installation modes.

It is still a further object of the present invention to provide a controller that does not interfere with the normal operation of a vessel's existing horn.

It is yet a further object of the present invention to provide a controller that has failure modes that do not interfere with a vessel's existing horn and/or light system.

It is yet another object of the present invention to provide a controller that is simply installed to protect against unintentional wiring mistakes.

It is still another object of the present invention to provide a controller that is economical and compact to efficiently cooperate with new and/or existing horn systems.

It is yet still another object of the present invention to provide a controller that has a pre-signal warning feature for reducing or eliminating some of the negative effects associated with horn signaling.

It is a further object of the present invention to provide a controller that recognizes, on the fly, whether a power/sail detecting circuit setting has been changed and modifies, as appropriate, the blast or signal pattern accordingly.

It is still a further object of the present invention to provide a controller suitable for providing a distress signal.

These and other objects and advantages of the present invention are achieved by a controller having an installation-type detector, a user interface with a mode selector, a microprocessor, a random number generator, and a timing system (e.g., electronic clock or timer). The controller cooperates with a vessel's horn to adjustably and/or automatically support one or more horn signaling pattern requirements of different vessels and for different situations.

BRIEF DESCRIPTION OF THE DRAWINGS

The above and other objects, advantages and benefits of the present invention will be understood by reference to the detailed description provided below as well as the accompanying drawings.

DETAILED DESCRIPTION OF THE INVENTION

Figure 1:
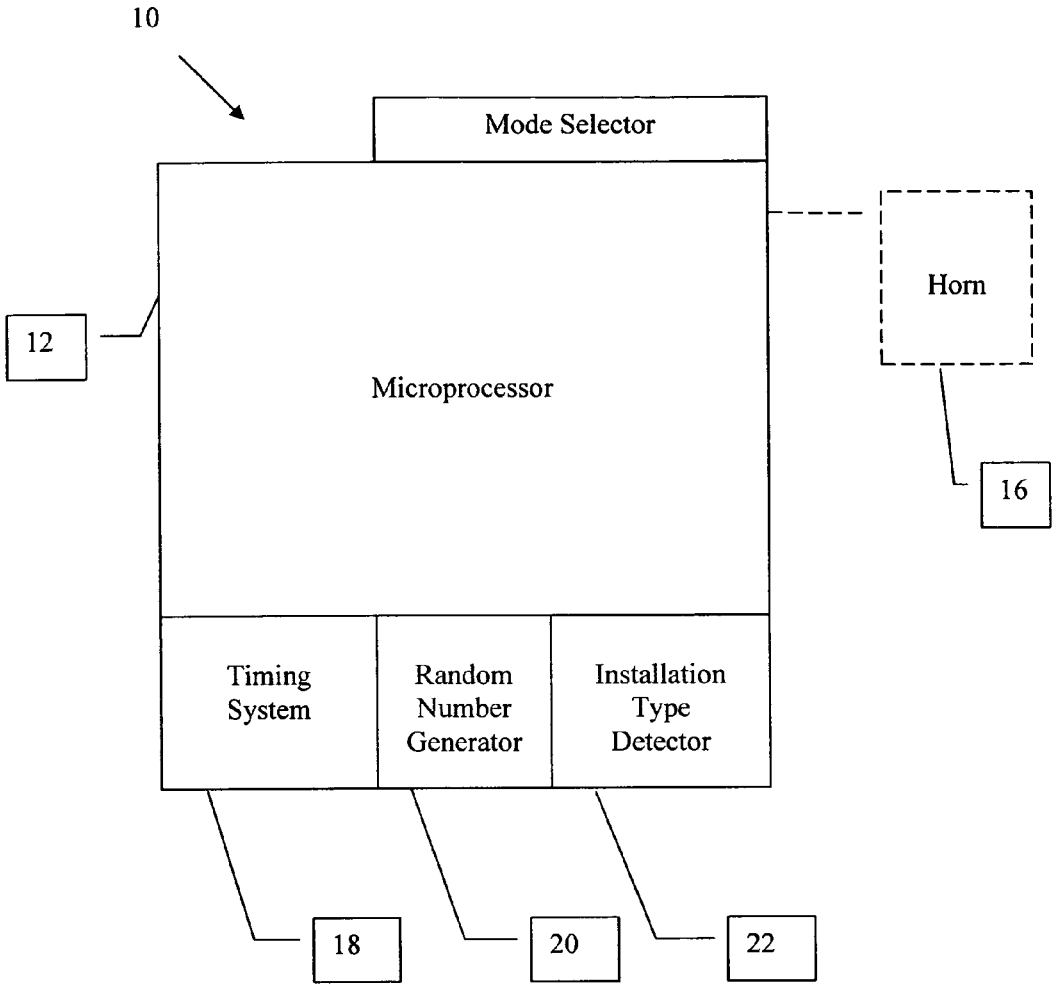
FIG. 1 is a block diagram of a controller in accordance with an illustrative embodiment of the present invention.

Referring now to the drawings, and in particular to FIG. 1, there is shown an illustrative embodiment of the present invention that has a horn controller generally represented by reference numeral 10. Controller 10 preferably has an installation-type detector 22, a user interface with a mode selector 14, a microprocessor 12 with a random number generator 20, and a timing system 18. The controller 10 cooperates with a vessel's horn, whistle, and/or dedicated foghorn 16 to adjustably and/or automatically sound a horn signaling pattern. Controller 10 preferably cooperates with microprocessor 12 to selectively sound horn 16 according to a specified mode or setting. The time period between the horn signals may be varied based on a delay time inserted by random number generator 20.

The activation of controller 10 depends on the type of installation employed. For example, if the installation type uses parallel signals for blast pattern selection (Type-A) as from a multi-position switch, controller 10 is activated by setting mode selector 14 to an "ON" position. Thus, by using parallel inputs from dedicated switches, the Type-A installation is well suited for new boat construction. Whereas, if the installation type is for serial signals for blast pattern selection (Type-B), as from multiple presses of a single switch, controller 10 can be activated using existing navigation lights or dedicated switch settings and/or a series of horn button presses when the navigation lights or dedicated power switch are turned on. In some embodiments of the present invention, Type-A and Type-B pattern selections can be mixed such that some patterns are selected by parallel means from a dedicated switch, and others by serial means. Thus, by using serial inputs from dedicated switches, the Type-B installation is well suited for retrofit construction.

Once controller 10 is activated, an installation type detector 22 determines the installation type of controller 10.

Mode selector 14 may be set to a number of positions that include an OFF position, and any one of a number of ON positions that represents different horn sounding patterns. When mode selector 14 is set in one of the active sounding positions, controller 10 will activate the microprocessor 12. For example, two modes of operation of controller 10 are possible for one embodiment of the present invention including only: Stopped and Underway.

In a Type-A installation, a separate mode selector 14 is required and the selector may be an "ON-OFF-ON" switch. Mode selector 14 may be set by the operator from the OFF position to either one of the ON operation modes. As discussed above, setting mode selector 14 to either ON position activates controller 10. For example, the first ON setting will be for the Stopped mode, while the second ON setting will be for the Underway mode.

After controller 10 is activated, microprocessor 12 determines which mode setting has been selected by mode selector 14. If for example, mode selector 14 is set to the Underway position, microprocessor 12 will activate the vessel's horn 16 according to the requirements for a vessel Underway. If mode selector 14 is set to the Stopped position, horn 16 will be activated according to the requirements for a Stopped vessel. In this embodiment of the invention, controller 10 stays in the ON mode until powered off. Changing the mode from Stopped to Underway or vice versa is accomplished through the same power up sequence since changing the mode requires the setting of mode selector 14 to be turned through the OFF position.

In a Type-B installation, controller 10 powers up with any "on" mode of the existing navigation lights switch and microprocessor 12 monitors the horn button for a limited time for an indication of the mode selection. The mode selection may be based on presses of the horn button by the operator. For example, no button press of horn indicates no horn signaling. One button press of horn may indicate the Underway mode, and two button presses of horn may indicate the Stopped mode. Numerous horn press commands may be programmed into the microprocessor 12 to support any number of different mode selection settings for controller 10. The microprocessor 12 may also reply with an acknowledgement of the number of horn presses detected from the operator. The acknowledgement may be in the form of a short acknowledge signal or blast via horn 16, a flashing light, and/or other suitable audible/visible signal.

In other embodiments, it is anticipated that the horn press signal could be generated by a mode selector 14 that is other than the horn switch. This embodiment allows for a larger number of patterns that would be supported by a more sophisticated user interface while preserving the mode selector interface to controller 10.

In mixed Type-A and Type-B installation, the dedicated mode selector 14 may be set by the operator to one of its indicated blast pattern modes, however, the setting can be overridden by receipt of Type-B signaling within a limited time period of being activated. This mixed mode allows for the most frequently used patterns being selected by dedicated switches and the less frequently used patterns being selected serially with the vessel's horn.

Controller 10 may include a timing system 18, such as an electronic clock or timer. Timing system 18 may be a separate component or may be part of microprocessor 12. Timing system 18 may be used to ensure that horn 16 is activated for the proper time period and to ensure the delays between the blasts are properly spaced.

Controller 10 may be installed in a power vessel or a sailboat configuration. For the Power Vessel configuration in the Stopped mode, two blasts are issued. Each blast is four seconds long separated by a two second interval. In the Underway mode, one four second blast is issued. The horn signaling pattern, for either mode, is repeated periodically until the power is removed. For the sailing vessel configuration, the horn signaling pattern is the same regardless of whether the vessel is underway or stopped. This horn signaling pattern is a long blast followed by two short (one second) blasts.

Controller 10 may be programmed to support different numbers of mode selections and horn signaling patterns. For example, different horn signaling patterns may be required for international, inland, or offshore signaling. In addition, COLREGS audible signaling requirements may be changed. Controller 10 may support horn signaling pattern requirements of different vessels for numerous types of situation as required.

Controller 10 may include the random number generator 20. In another embodiment of the invention, the random number generator 20 may be part of microprocessor 12. In yet another embodiment of the invention, the random number generator 20 may be provided as a computer software program for microcontroller 12.

The random number generator 20 may add a random or pseudo random time length to the base period of time between the horn signaling pattern by microprocessor 12. The addition of a random time length helps to prevent a situation in which two nearby vessels have their horns blasting on a synchronized schedule, causing the vessels to miss hearing each other's blast because their own blast was masking the blast of the other vessel. Random number generator 20 does not depend on the variability of components or other techniques in which the randomness of the pattern is not guaranteed.

The silent interval between the horn signaling patterns preferably never exceeds 120 seconds. The length of the silent interval is determined by adding together a fixed base time and a random or pseudo random time interval. For example, a base time of 103 seconds could be added to a pseudo random time ranging from 0 to 17 seconds. Preferably, the base time is selected for each horn signaling pattern such that when added to the maximum random or pseudo random time, the sum does not exceed a preferable two (2) minute maximum interval specified by the COLREGS.

The random number generator 20 may be in the form of software that provides a pseudo random number generator function with a sequence of sufficient period that the sequence repeats only after a period of hours of operation. For example, assuming an average cycle time of 116.5 seconds (the average of 113 seconds and 120 seconds) a 128 step pattern would repeat about every 4.14 hours.

In another embodiment of the present invention, the random number generator 20 is preferably not required and the silent interval between horn signaling patterns is preferably not varied, and set to a specific base time (e.g., 120 seconds).

Figure 2:
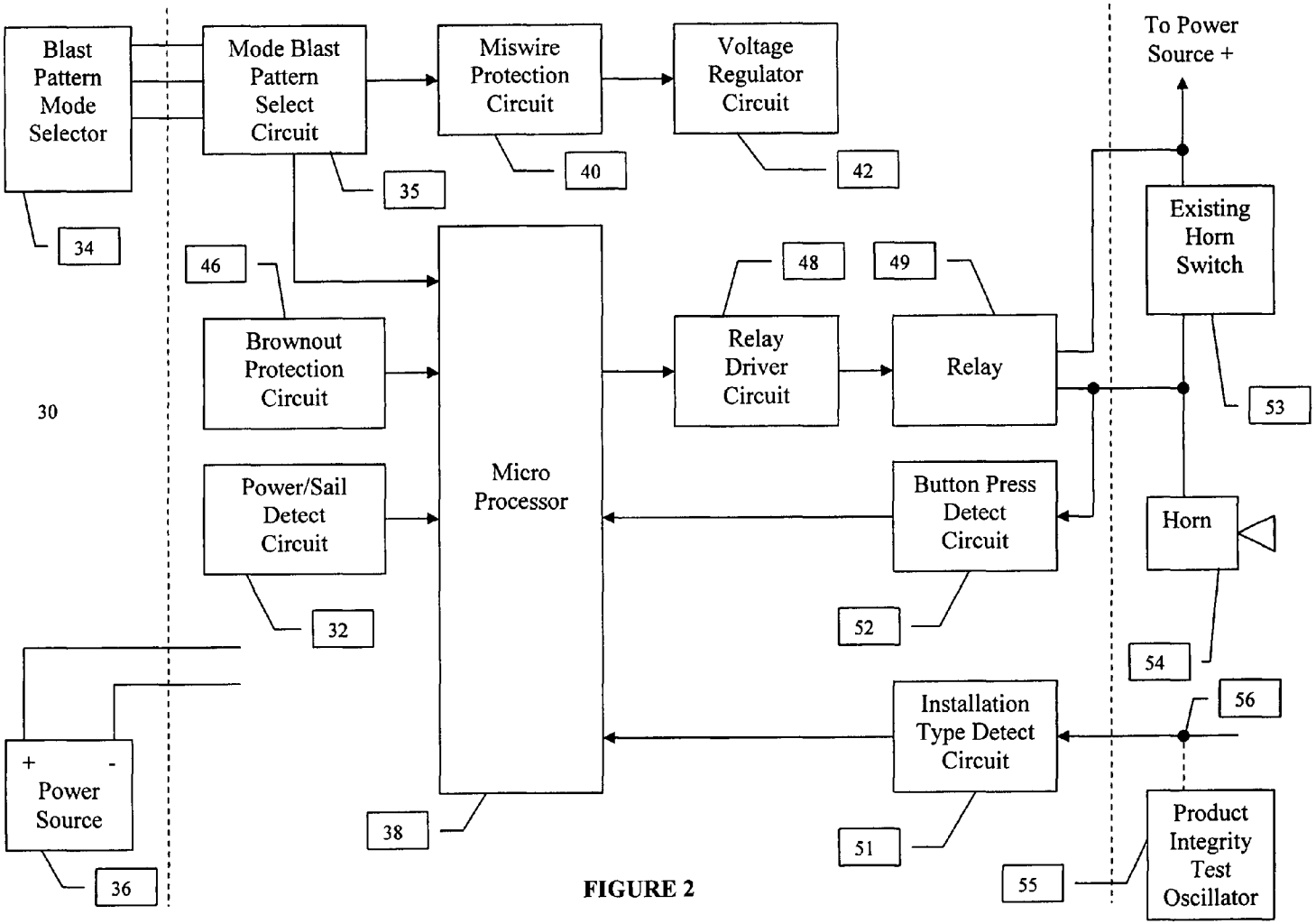
FIG. 2 is a block diagram of a controller circuit for the controller of FIG. 1.

Referring to FIG. 2, a block diagram of one illustrative embodiment of a horn controller circuit 30 of controller 10 is shown. The horn controller circuit 30 preferably has a installation type detect circuit 51 that allows software running in a microprocessor 38 to determine how the controller 10 was installed (either Type-A or Type-B).

If the "Installation Type" wire leading to the circuit is left unconnected (floating) or is connected to power source+, the controller 10 operates in the Type-B installation configuration that using the horn button presses or other serial means for selecting the horn signaling pattern or blast pattern mode. If the "Installation Type" wire is connected to power source−, the controller 10 operates in the Type-A installation configuration, which requires a separate blast pattern mode selector 34 for specifying the horn signaling pattern. Mode blast pattern selector 34 serves two functions: power on/off, and selection of the mode of operation of the desired horn signaling pattern.

When the blast pattern mode selector 34 is in the OFF position, no power is provided to the controller 10 and it remains inoperative.

When the blast pattern mode selector 34 is not in the OFF position, the mode horn signaling pattern selection circuit 35 allows the software running in the microprocessor 38 to determine the setting (mode of operation) of mode horn signaling pattern selector. In a Type-A installation, for example, the setting is determined by the dedicated switch setting. In a Type-B installation, for example, the setting is determined by the pattern of horn button presses.

Although generally referred to as a switch in the Type-A installation, the blast pattern mode selector 34 is not constrained to be a simple mechanical switch. The blast pattern mode selector 34 may be of any arbitrary complexity and may signal microprocessor 12 by digital signaling, different DC voltage levels, frequency encoding, or other electronics. Because the recommended horn signaling patterns differ for vessels under power and vessels under sail, power/sail detecting circuit 32 signals microprocessor 38 to select the correct pattern based on the power/sail detect circuit setting. The power/sail detecting circuit 32 can be monitored by the microprocessor 38 on the fly or continuously to determine if the setting has changed from power to sail or from sail to power. If a change in setting has occurred microprocessor 38 will change the blast pattern accordingly.

In one embodiment of the present invention, the power/sail detect circuit 32 may be connected directly to the power source+or left unconnected for a vessel under power, or connected the power source− for a vessel always under sail.

In another embodiment, the power/sail detect circuit 32 may be a switch that allows the user to switch between the power and sail horn signaling patterns. This is useful for vessels that operate both under power and under sail.

A power source 36 provides power to the controller 10. A battery may act as the power source 36. Alternatively, the power source 36 may be a generator or a 12-volt or other DC converter. The power source 36 supplies a nominal voltage sufficient to power the controller 10 and the horn 54.

The two installation modes supported by controller 10 allow non-professional installers to retrofit the controller onto their vessels. A miswire protection circuit 40 is designed to prevent damage to the controller 10 should the connection to the power source be reversed.

The microprocessor or microcontroller 38 has memory to store the controller software. Under software control, the microprocessor 38 determines the installation type, the vessel type (power or sail), the horn signaling pattern mode of operation, and performs all of the timing and control necessary to operate controller 10.

A voltage regulator circuit 42 is used to provide a regulated voltage for use internally in the controller 10. A brownout protection circuit 46 causes the reset signal of the microprocessor 38 to be asserted when the +5 volt supply dips below a preset level at which the operation of the microprocessor is unpredictable. This will halt operation in the event of a voltage brownout condition. When the voltage re-stabilizes, controller 10 will reset. A relay driver circuit 48 is used to control a relay 49. The two contacts of the relay 49 may be wired in parallel with an existing horn button or existing horn switch 53. Actuating relay 49 provides the same effect as pressing the existing horn button 53, namely to sound horn 54.

The existing horn button 53 may operate independently of the controller 10 to allow the operator to sound the horn 54 as needed regardless of whether the controller is powered OFF or set in one of its horn signaling pattern modes.

A button press detect circuit 52 is used to determine if existing horn button 53 is being pressed.

In one embodiment of the Type-B installation where the existing navigation lights switch is used as the blast pattern mode selector 34, the controller 10 is powered when the navigation lights are in use. The navigation lights may need to be used without operating the foghorn such as on a fogless night. In this circumstance, the controller 10 must determine if the horn 54 should be used as a foghorn. To do this, the controller 10 checks the state of the horn button 53 after being powered up. The controller 10 may be powered by the navigation lights or a dedicated power switch. If the horn button 53 is pressed within some defined limited time period after the controller 10 is powered up, the controller 10 operates the horn 54 normally as a foghorn in the selected blast pattern mode.

In other embodiments of the Type-B installation of the present invention, the user may select the type of horn signaling pattern by initially pressing the horn button 53 during the power up of the controller 10. For example, pressing the horn button 53 once could signal the microprocessor 38 to sound the horn signaling pattern for the Underway mode. For example, pressing the horn button 53 twice could signal the microprocessor 38 to sound the horn signaling pattern for a Stopped mode. The horn pressing mode selection method may be extended to support any arbitrary number of patterns.

It is anticipated that more sophisticated user interfaces might be used to select from a larger number of horn blast patterns. The simple pulse counting method used for counting horn button can be extended to count pulses created by an off-board pattern selector.

Referring now to FIGS. 3A to 3D, a logic diagram 70 shows the operational steps of the system and method of the present invention. In other embodiments, the patterns described earlier would be implemented by extending the mode selector 14, and branching down the logic paths 102 and 114 to sound the alternate patterns. As shown in FIGS. 3A to 3D, the following steps may be followed by the microprocessor 38 during the operation of the controller 10 of the present invention. The diagram 70 details operation for the controller 10, which supports the Stopped and Underway horn signaling pattern modes.

The controller 10 may be activated in one of two ways by turning the mode selector 14 on for the Type-A installation, or by a series of horn button presses at the time the navigation lights are turned on for the Type-B installation. Horn controller activation is shown in logic block 72 of FIG. 3A.

After the controller 10 is activated, the next step is to initialize the microprocessor 38 as shown in block 74. The initialization of the microprocessor 38 may include the configuration of I/O pins, the turning off of the relay, system integrity check, and the initialization of a random number generator.

Following initialization, an internal counter is checked to determine whether a manufacturing self test 76 is to be performed. This counter may be connected to a product integrity test oscillator 55, which may be a laboratory frequency generator or other oscillator, connected to the installation type detect circuit input 56. The counter is configured to count transitions from a logical 0 to a logical 1. Following a pre-determined delay, the value of the counter is read. If the value contained in the counter is within a certain range, the microprocessor 38 enters the self test mode 120. If the counter value falls outside of the range, the microprocessor 38 proceeds with normal operation as shown at 78. This self test feature is valuable for allowing the device to self-test itself outside the vessel installation (such as a manufacturing test) by simply applying a specified frequency square wave (from the connected oscillator 55) to the installation type detect circuit input 56.

If the self test is not performed as shown in the logic block 76, the block 78 reads the installation type of the controller 10. Blocks 82 and 83 determine the mode horn signaling pattern for Type-A installations and block 86 determines the mode horn signaling pattern for Type-B installations. As shown in block 80, the installation type is determined. It may be either a Type-A installation or a Type-B installation.

If a Type-A installation is determined or detected, the horn press signal is preferably monitored at 83. It is at this point that an SOS mode 85 may be selected via a predetermined horn press signal pattern (e.g., five presses). If SOS mode 85 is not selected during the limited period provided for detecting such, the vessel type (i.e., power or sail) is determined at block 92. If a Type-B installation is detected, the horn press signal is monitored at 86 to determine whether this is a horn initialization, or not. If there is no horn press signal for a limited time period for a Type-B installation, the microprocessor 38 halts or shuts down the controller 10 as shown in block 88. Also, as with the Type-A installation, an SOS mode 85 may be selected at this point via a predetermined horn press signal pattern (e.g., five presses). If SOS mode 85 is not selected during the limited period provided for detecting such, and if horn press activity is detected, the horn press activity is acknowledged at block 89 and the logic path joins that of the Type-A installation and checks for whether it is a power or sail vessel as shown in block 92.

Figure 3A:
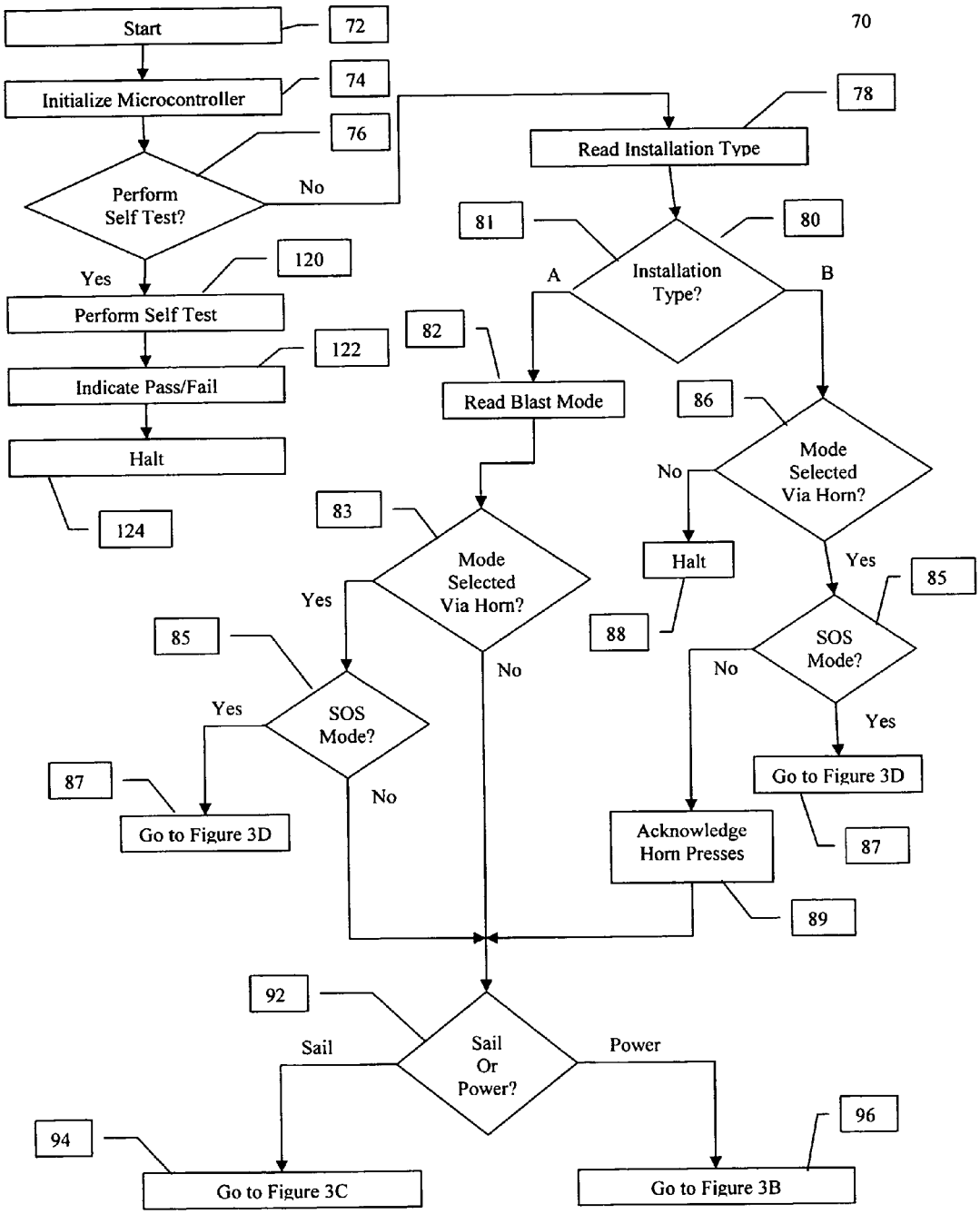
FIGS. 3A through 3D are a logic diagram in accordance with an illustrative embodiment of the present invention.

If block 92 determines that the vessel is a vessel under sail, the next step is block 94. If block 92 determines that the vessel is a power vessel, the next step is block 96. Blocks 96 and 94 indicate that the next logic blocks are shown in FIGS. 3B and 3C, respectively.

Figure 3B:
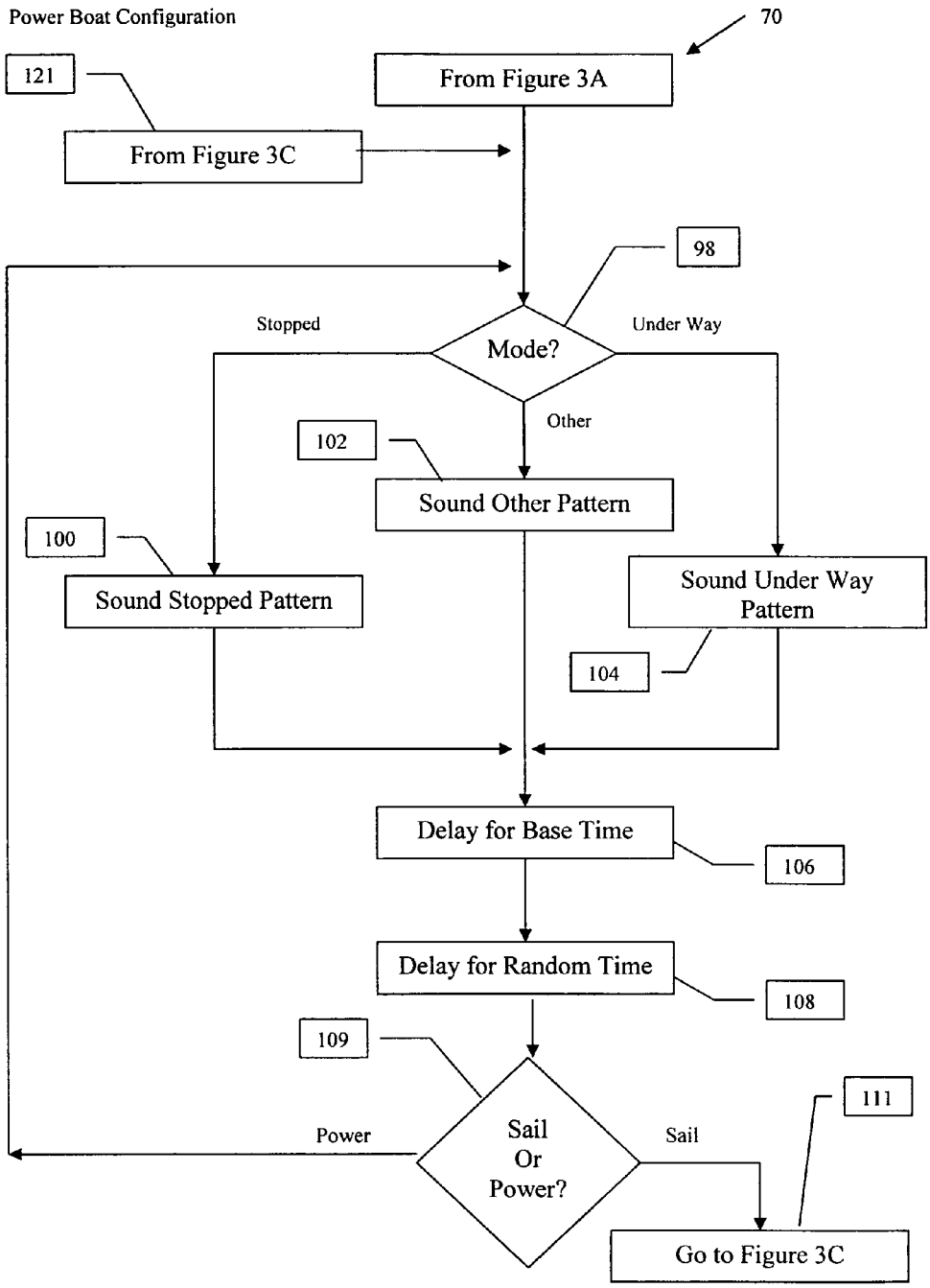
Figure 3C:
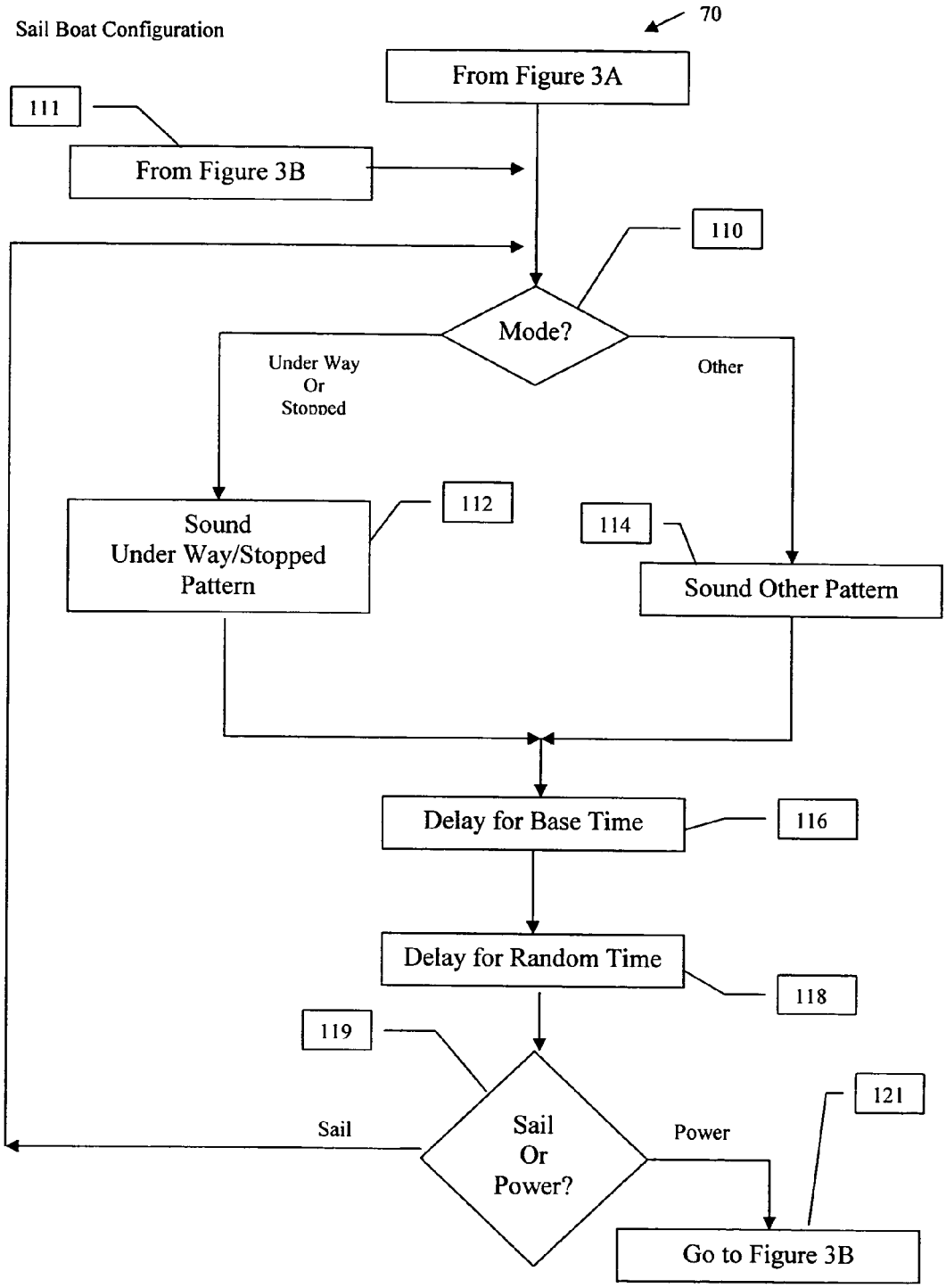

Referring to FIG. 3B, logic blocks are shown corresponding to a power boat configuration. After block 96 of FIG. 3A, the next step is shown in block 98. The blast mode is determined as shown in block 98. The blast mode is determined from the setting of mode selector 34 (a switch setting for a Type-A installation, or the navigation lights switch setting and/or series of horn presses for a Type-B installation, or either switch setting or horn press for a mixed Type A/B installation). If a Stopped pattern is selected, it is sounded as shown in block 100. If an Underway pattern is selected, it is sounded as shown in block 104. Other embodiments may select the other less used patterns, and when detected would be sounded 102.

The next step is to delay for the base time period as shown in block 106. A random time delay period supplied by a random number generator may then be added to the base time as shown in block 108. At this point an on the fly determination of whether there has been a change in the vessel operation mode (i.e., from power to sail) as shown in block 109. If it is determined in block 109 via power/sail detecting circuit 32 that no change has occurred (i.e., vessel remains in power mode), the next step is to then return to block 98 and repeat the horn signaling pattern sequence. If it is determined in block 109 via power/sail detecting circuit 32 that the vessel's operation mode has changed from power to sail, the next step is block 111, which indicates that the next logic blocks are shown in FIG. 3C.

If it is determined in block 92 of FIG. 3A that the vessel is under sail, the next step is block 94. Referring to FIG. 3C, the logic blocks for a sail boat configuration are shown. The blast mode for a vessel under sail is determined as shown in block 110. The blast mode is determined from the setting of the mode selector 34. If an Underway or Stopped pattern is detected (they are identical for sailing vessels), the horn signaling pattern is sounded as shown in block 112. Other embodiments of the controller 10 of the present invention may include additional mode selector settings of other less used horn signaling patterns, and other sound patterns as shown in block 114.

In the same manner as for power vessels, block 116 shows that there is a delay for the base time period. A random time delay period supplied by a random number generator may then be added to the base time period as shown in block 118. At this point an on the fly determination of whether there has been a change in the vessel operation mode (i.e., from power to sail) as shown in block 119. If it is determined in block 119 via power/sail detecting circuit 32 that no change has occurred (i.e., vessel remains in power mode), the next step is to then return to block 110 and repeat the horn signaling pattern sequence. If it is determined in block 119 via power/sail detecting circuit 32 that the vessel's operation mode has changed from power to sail, the next step is block 121, which indicates that the next logic blocks are shown in FIG. 3B.

If the SOS mode 85 is selected during the limited period provided for detecting such in the Type-A installation or the Type-B installation, the next step is block 87. Block 87 indicates that the next logic blocks are shown in FIG. 3D.

Figure 3D:
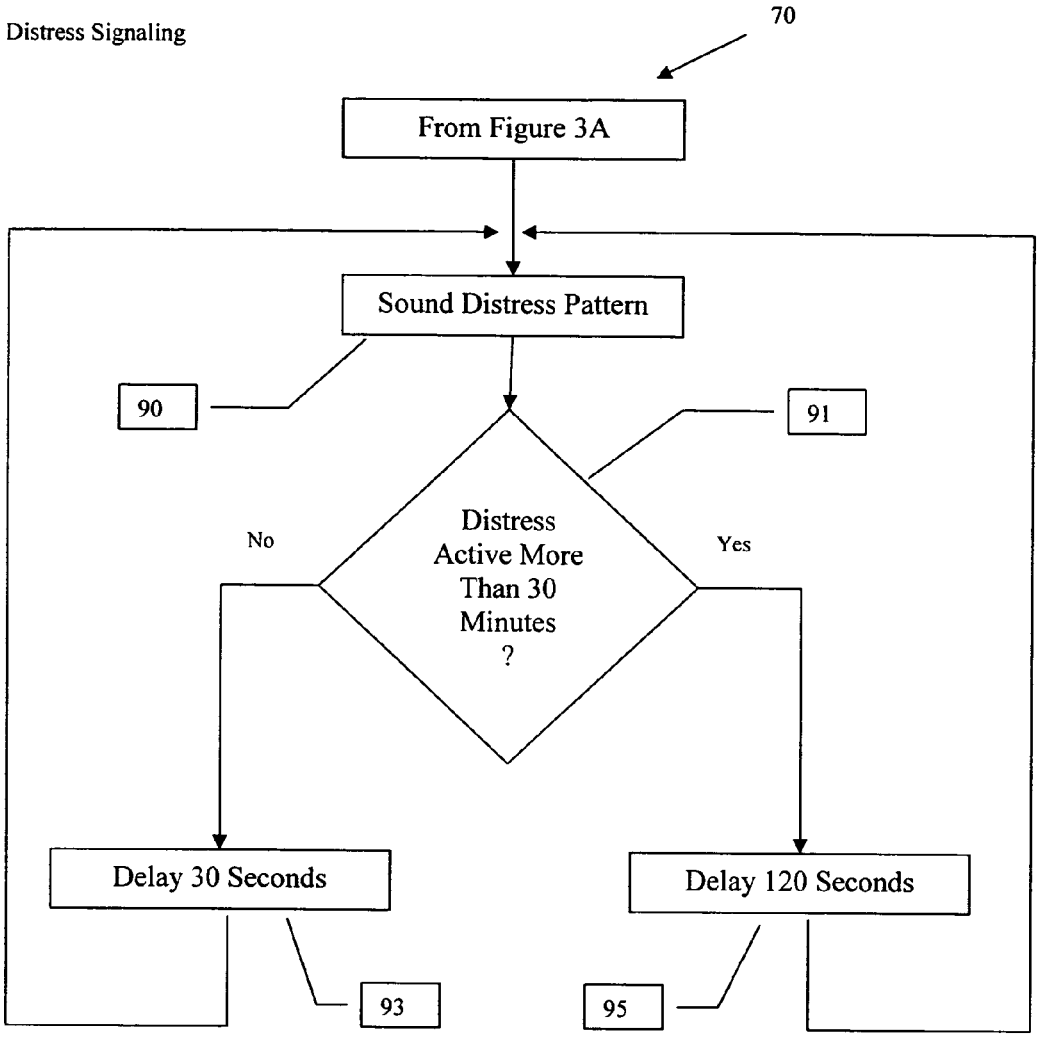

Referring to FIG. 3D, logic blocks are shown corresponding to the generation of a distress signal. After block 87 of FIG. 3A, the next step is shown in block 90. The sound distress pattern or signal is provided as shown in block 90. The next step is to determine whether the distress signal has been active for more than 30 minutes as shown in block 91. If the distress signal has been active for less than 30 minutes, a delay or a silent period of about 30 seconds as shown in block 93 is implemented and followed by a return to block 90 and a repeat of the distress signal pattern. If the distress signal has been active for more than 30 minutes, a delay or a silent period of about 120 seconds as shown in block 95 is implemented and followed by a return to block 90 and a repeat of the distress signal pattern.

Referring again to FIG. 1, the controller 10 may support a number of different types of boat installations including a Type-A and/or a Type-B installation. One embodiment of the present invention allows for a Type-A installation, which requires a separate mode selector 14 that may be a switch. This is the preferred installation for new boat construction because it allows use of the controller 10 independent of the navigational lights and horn switch. The mode selector 14 may be set to "Stopped-OFF-Underway" positions. Moving the mode selector 14 setting from OFF to either of the other two ON positions activates the controller 10 and initiates operation of the horn 16. In other embodiments of the invention, additional ON position settings may be added to the mode selector 14 for more than two horn signaling pattern selections in a Type-A installation.

For example, in other embodiments of the Type-A installation, the "Stopped-OFF-Underway" switch may be replaced by a multi-position switch, or other user interface with electronic signaling to the microprocessor 12 to allow for more than two horn signaling patterns.

An embodiment of the present invention permits a Type-B installation, which is preferred for retrofitting the controller 10 to an existing boat or vessel. A Type-B installation uses the existing navigation lights power switch or other dedicated power switch in conjunction pressing the horn button as the mode selector 14 to select the mode of operation. Use of the navigation lights power switch allows for retrofitting the controller 10 in existing boats or vessels without requiring an additional switch on the console (as required in a Type-A installation). In one embodiment of a Type-B installation, turning on the navigation lights while sounding a series of blasts of the vessel's horn using the existing manual horn button or switch activates the controller 10. The controller 10 senses whether the Stopped or Underway navigation lights are on and how many horn blasts occurred and operates horn 16 in the corresponding mode.

For both Type-A and Type-B installations, manual control of the vessel's horn 16 bypasses the controller 10, and thus, will always override the controller 10. Manual bypassing of the horn 16 does not turn off the controller 10, it will continue sounding the horn 16 on its regular period.

In another embodiment of the present invention, the mode selector 14 may include additional settings that will activate the horn 16 according to other COLREGS requirements, e.g., a vessel not under command (one prolonged blast followed by two short blasts), a towed vessel (one prolonged blast followed by three short blasts), or a vessel at anchor (one short blast, one prolonged blast, one short blast). In another embodiment of the present invention, the mode selector 14 may include settings and outputs to activate a bell in addition to the horn, whistle or dedicated foghorn. Bell sounding patterns are different from the horn patterns.

It is noted with respect to the distress signal feature discussed above with respect to FIG. 3D that although the COLREGS Rule 37 does not require a specific signal or blast pattern for distress signaling, it does require that a vessel "sound foghorn continuously". This requirement for continuous sounding can have a negative effect on a vessel's horn such as overheating, which can cause the horn to temporarily stop operating and can eventually lead to more permanent damage. Accordingly, the distress signal feature of the present invention sounds in a step down frequency method. That is, the distress signal sounds almost continually for an initial period of a few minutes to attract immediate attention to the distress situation. Following this initial period the frequency of the signal steps down to sound only periodically at a first interval, such as for example, every minute or so, and then down again to sound at a second interval, such as for example, every two minutes or so. This signal frequency step down allows the horn to remain cool and thereby preserves the useful life thereof.

In still another embodiment of the present invention, the controller 10 has an optional pre-signal warning feature. For example, an audible and/or a visual signal may be used to mitigate the unpleasant effects associated with the sudden onset of the sound navigational signals. The pre-signal warning feature provides an audio and/or visual warning signal, which precedes any sound navigational signal by a predetermined time interval. The time interval can be selectively fixed and/or variable. Examples of different pre-signal warning features include the following: a controlled slow ramp up of the volume of the horn 16; a short signal or chirp of the horn 16; a sound (e.g., tones, music, clicks, and/or recorded or synthesized voice) sounded through a speaker or other audio actuator that is separate and distinct from the horn 16; a sound in accordance with Annex III of the COLREGS, including implementing a "close quarters" warning to other vessels of close proximity; a flashing strobe or other widely visible light; a controlled use of existing vessel lights (e.g., cabin lights, hallway lights, bridge lights, and/or other non-navigational vessel lighting); and/or a visual indicator proximate the vessels helm control panel.

The present invention also provides a method of sounding the horn 16 by determining a setting, and based on the setting sounding a horn signaling pattern. The setting may be based on a mode selector 14 setting that is set to a Stopped or Underway position. The setting may be based on a switch setting (Type-A) or the setting may be based on a navigation light setting and series of horn switch presses (Type-B). The method may include inserting a delay time, preferably a random delay time, between the blast pattern to prevent overlapping of foghorn signals on different vessels.

The present invention also provides controller 10 that may be retrofitted to a vessel by connecting the controller to an existing navigation lights system and an existing horn 16. The controller 10 determines the navigation lights setting and/or series of horn switch presses (e.g., Stopped or Underway) and sounds a horn signaling pattern based on the navigational light switch settings. The controller 10 has microprocessor 12 that determines the navigation lights switch setting, and sounds the horn signaling pattern based on the lights setting. The navigation lights switch setting may act as mode selector 14. The controller 10 may be mounted behind the console, and not on the vessel console.

The present invention also provides a method of retrofitting the controller 10 on a vessel that has connected the controller to the existing navigational lights system, and connecting the controller to the existing horn 16. The connection allows the controller 10 to sound a horn signaling pattern based on the navigation lights switch setting and series of horn button presses. The method may also include mounting the controller 10 behind the console.

In a further embodiment of the present invention, the controller 10 has a way to vary the time delay between a horn signaling pattern. For example, the time delay may be inserted by a random number generator in the microprocessor software. The varying of the time delay between the vessel's horn signaling pattern greatly increases safety.

The controller 10 may include a self test mode that is automatically activated when the controller is activated by an attached test device. If controller 10 fails the self test, the controller is shut off and a warning signal may be sounded, or a warning light activated.

The present invention having been thus described with particular reference to the preferred forms thereof, it will be obvious that various modifications may be made therein without departing from the spirit and scope of the present invention.

What is claimed is:

1. A controller for cooperating with a vessel's existing horn to automatically generate sound navigational signals, said controller comprising:

an installation-type detector for determining a controller installation type;

a user interface with a mode selector having one or more mode settings; and a microprocessor for communicating with said mode selector and said horn to facilitate the selective control of said horn.

2. The controller of claim 1, wherein the controller is activated by said mode selector.

3. The controller of claim 2, wherein said installation-type detector determines said controller installation type when the controller is activated.

4. The controller of claim 3, wherein said controller installation type is for parallel signaling for blast pattern selection.

5. The controller of claim 4, wherein said microprocessor is activated by the controller when said mode selector is set in one of said one or more mode settings.

6. The controller of claim 5, wherein said microprocessor determines which of said one or more mode settings has been selected.

7. The controller of claim 1, wherein the controller is activated by a vessel's existing controls.

8. The controller of claim 7, wherein said installation-type detector determines said controller installation type when the controller is activated.

9. The controller of claim 8, wherein said controller installation type is for serial signaling for blast pattern selection.

10. The controller of claim 9, wherein said microprocessor is activated by the controller when said mode selector is set in one of said one or more mode settings.

11. The controller of claim 10, wherein said microprocessor cooperates with said vessel's existing controls to determine which of said one or more mode settings has been selected.

12. The controller of claim 1, wherein the controller cooperates with a timing for ensuring said sound navigational signals are properly timed and/or spaced.

13. The controller of claim 12, wherein said timing system is a separate component separate from said microprocessor.

14. The controller of claim 12, wherein said timing system is part of said microprocessor.

15. The controller of claim 1, wherein the controller is programmable to support a variety of different mode selections and/or any combinations thereof.

16. The controller of claim 1, wherein said random number generator is part of said microprocessor.

17. The controller of claim 1, wherein said random number generator is a computer software program for said micro processor.

18. The controller of claim 1, further comprising a random number generator.

19. The controller of claim 18, wherein said random number generator adds a random or a pseudo random time length to a base period of time between said sound navigational signals.

20. The controller of claim 19, wherein said added random or pseudo random time length provides anti-synchronization for preventing any overlapping of sound navigational signals between different vessels.

21. The controller of claim 19, wherein said random number generator operates independent of any innate variability associated with different components.

22. The controller of claim 19, wherein said random or pseudo random time length is in a range of 0 seconds to 120 seconds less said base period of time.

23. The controller of claim 22, wherein the sum of said pseudo random time length and said base period does not exceed 120 seconds.

24. The controller of claim 1, wherein the controller has a power/sail type detecting circuit.

25. The controller of claim 24, wherein said power/sail type detecting circuit is selectively connectable to a power source for a vessel under power and/or a power source for a vessel under sail.

26. The controller of claim 25, wherein the controller has a miswire protection circuit for protecting the controller from improper installation.

27. The controller of claim 24, wherein said power/sail type detecting circuit is monitored by said microprocessor to determine any change in status.

28. The controller of claim 1, wherein said microprocessor has memory to store controller software.

29. The controller of claim 1, wherein the controller has a brownout protection circuit for causing a reset signal of said microprocessor to be asserted when the power supply falls below a predetermined level.

30. The controller of claim 1, wherein the controller has a relay driver circuit for controlling a relay electrically connected to said existing navigational controls.

31. The controller of claim 1, wherein the controller has a pre-signal warning feature.

32. The controller of claim 31, wherein said pre-signal warning is an audible signal.

33. The controller of claim 31, wherein said pre-signal warning is a visual signal.

34. The controller of claim 1, wherein the controller has an automated distress signal feature.

35. The controller of claim 34, wherein said distress signal feature has a predetermined signal pattern.

36. The controller of claim 35, wherein said signal pattern is the Morse code SOS pattern.

37. The controller of claim 35, wherein said signal pattern has a cycle or frequency step down feature.

38. The controller of claim 1, wherein said microprocessor can reply with an acknowledgement to interaction detected from an operator.

39. The controller of claim 1, wherein a vessel's existing controls are used to activate the controller and to select one or more signal settings.

40. The controller of claim 1, wherein said installation-type detector further comprises a circuit being connected to the controller having program instructions for said circuit to determine the controller installation type, said installation type detector and the controller in response thereto selecting a sound navigational signaling pattern, said selection being dependent upon a configuration of the vessel type.

41. A method for automatically generating sound navigational signals comprising the steps of:

providing a horn or a signaling device, said signaling device having a controller having an installation-type detector for determining a controller installation type, a user interface with a mode selector having one or more mode settings, and a microprocessor for communicating with said mode selector and said horn to facilitate the selective control of said horn to generate sound navigational signals;

activating said controller via said mode selector of said user interface;

initializing said microprocessor via said mode selector;

determining said controller installation type via said installation-type detector;

determining which of said mode settings has been selected via said microprocessor; and generating sound navigational signals via said horn in accordance with said selected mode.

42. The method of claim 41, further comprising a step of performing a self test is implemented after said step of initializing of said microprocessor and prior to said step of determining controlling installation type.

43. The method of claim 41, further comprising a step of determining whether the controller is cooperating with a vessel under sail or a vessel under power is implemented after said step of determining which of said mode settings has been selected and prior to said step of generating sound navigational signals.

44. The method of claim 41, further comprising a step of providing a pre-signal warning to be implemented after said step of determining which of said mode settings has been selected and prior to said step of generating sound navigational signals.

45. The method of claim 44, wherein said pre-signal warning is an audio signal, a visual signal or a combination thereof.

46. The method of claim 41, further comprising a step of providing a delay for a base time period following said step of generating sound navigational signals.

47. The method of claim 46, further comprising supplying a random time delay by a random number generator and adding to said base time period.

48. The method of claim 47, further comprising a step of repeating said sound navigational signal in accordance with said mode selector to be implemented after said step of adding said random time delay to said base time period.

49. A controller for cooperating with a vessel's existing horn to automatically generate sound navigational signals, said controller comprising:

an user interface functionality detector for determining a controller installation type;

a user interface with a mode selector having one or more mode settings; and a microprocessor for communicating with said mode selector and said horn to facilitate the selective control of said horn.

50. The controller of claim 49, wherein said user interface functionality detector determines said controller installation type from a plurality of controller installation types with each of said plurality of controller installation types being different from one another.

* * * * *